United States Patent [19]

Kiwala et al.

[11] Patent Number: 4,627,449

[45] Date of Patent: Dec. 9, 1986

[54] PROCESS FOR AUGMENTING OR ENHANCING AROMA OR TASTE OF SMOKING TOBACCO AND SMOKING TOBACCO ARTICLE USING ALDEHYDE COMPOSITION

[75] Inventors: Jacob Kiwala, Brooklyn, N.Y.; Braja D. Mookherjee, Holmdel; Robert W. Trenkle, Point Pleasant, both of N.J.

[73] Assignee: International Flavors & Fragrances Inc., New York, N.Y.

[21] Appl. No.: 754,122

[22] Filed: Jul. 12, 1985

[51] Int. Cl.[4] ..... A24B 3/12; A24B 15/30

[52] U.S. Cl. ..... 131/276

[58] Field of Search ..... 131/276, 277, 278, 279

[56] References Cited

U.S. PATENT DOCUMENTS

| | | | |
|---|---|---|---|
| 4,434,086 | 2/1984 | Hill et al. | 252/522 R |
| 4,462,880 | 7/1984 | Hill et al. | 204/161 |
| 4,476,041 | 10/1984 | Hill et al. | 252/522 R |
| 4,488,973 | 12/1984 | Hill et al. | 252/8.6 |

OTHER PUBLICATIONS

Leffingwell et al, "Tobacco Flavoring for Smoking Products", published by R. J. Reynolds Tobacco Co., 1972, pp. 19–22.

*Primary Examiner*—V. Millin

*Attorney, Agent, or Firm*—Arthur L. Liberman

[57] ABSTRACT

Described is a method for augmenting or enhancing the aroma or taste of smoking tobacco or smoking tobacco articles by adding to smoking tobacco or to at least one section of the smoking tobacco article, e.g., the paper, the filter or the body of tobacco, a mixture consisting essentially of:

(a) from about 0.5 up to about 7% by weight of said composition of n-hexanal;

(b) from about 5 up to about 21% by weight of said composition of n-octanal;

(c) from about 30 up to about 80% by weight of said composition of n-nonanal;

(d) from 0 up to about 40% by weight of said composition of n-decanal;

(e) from 0 up to about 7% by weight of said composition of n-tetradecanal;

(f) from about 7 up to about 12% by weight of said composition of n-heptanal;

(g) from 0 up to about 12% by weight of said composition of n-undecanal; and (h) from 0 up to about 12% by weight of said composition of n-dodecanal.

Particularly, on smoking the side stream is modified and masked. The smokey, phenolic, cresolic odor is covered and the aroma in the environment around the smoked cigarette is clean and slightly citrusy.

4 Claims, No Drawings

PROCESS FOR AUGMENTING OR ENHANCING AROMA OR TASTE OF SMOKING TOBACCO AND SMOKING TOBACCO ARTICLE USING ALDEHYDE COMPOSITION

BACKGROUND OF THE INVENTION

This invention relates to the use of:

(a) from about 0.5 up to about 7% by weight of said composition of n-hexanal;

(b) from about 5 up to about 21% by weight of said composition of n-octanal;

(c) from about 30 up to about 80% by weight of said composition of n-nonanal;

(d) from 0 up to about 40% by weight of said composition of n-decanal;

(e) from 0 up to about 7% by weight of said composition of n-tetradecanal;

(f) from about 7 up to about 12% by weight of said composition of n-heptanal;

(g) from 0 up to about 12% by weight of said composition of n-undecanal; and (h) from 0 up to about 12% by weight of said composition of n-dodecanal, in augmenting or enhancing the aroma or taste of smoking tobacco or smoking tobacco articles.

Fresh, clean, citrusy aroma and taste characteristics both prior to and on smoking in the main stream and in the side stream and in the environment around the smoking cigarette are highly desirable characteristics in formulation of smoking tobacco and in the production of smoking tobacco articles.

The environment around a smoking tobacco article during the smoking process has, in addition to the standard tobacco aroma, a smokey, phenolic, cresolic aroma. There is a need to mask this aroma in the environment around the smoking cigarette or other tobacco article, e.g., cigar.

Although Leffingwell "Tobacco Flavoring For Smoking Products" published by R. J. Reynolds Tobacco Company, 1972 indicates that individual aldehydes have specific smoke aromas, e.g.:

| Compound | Smoke Taste | Smoke Aroma |
|---|---|---|
| Butyraldehyde | | harsh, green chemical herbaceous green |
| n-decanal | green, citrus | green, waxy, fatty |
| heptanal | fatty, green | fatty, green |
| n-hexanal | spicy, green apple, fatty-waxy | green, fatty |
| n-nonanal | fatty, floral, waxy | fatty, floral, waxy |
| n-octanal | fatty, sweet | fatty |
| undecanal | fruity, sweet, waxy-floral | sweet, fruity-fatty |

Leffingwell, however, does not show that a specific combination of specific aldehydes has the power to mask the smokey, phenolic, cresolic aroma and at the same time effect a citrusy, fresh, clean aroma in the main stream and the side stream of the cigarette on smoking and in the environment around the smoking cigarette or other smoking tobacco article.

Additional prior art indicates that straight chain aldehydes are useful in augmenting or enhancing the aroma of perfume compositions, colognes and perfumed articles. Thus, Arctander "Perfume and Flavor Chemicals (Aroma Chemicals)", published by the author in 1969 discloses that n-nonanal is useful in augmenting or enhancing or imparting floral aromas at Monograph 2343. By the same token, Arctander indicates that n-octanal is useful in imparting citrusy and floral aromas at Monograph 2397. n-Undecanal is shown by Arctander at Monograph 3028 to be useful in imparting "fresh air" odors and also to have a floral and refreshing odor.

U.S. Pat. No. 4,462,880 issued on July 31, 1984 contains claims drawn to a process for preparing a fresh air aroma comprising the steps of:

(i) saturating a natural fiber textile with water;

(ii) admixing with said water-saturated natural fiber textile at least one organic acid selected from the group consisting of oleic acid, linoleic acid and linolenic acid or glyceride ester thereof;

(iii) exposing the resulting product to a gas selected from the group consisting of air, oxygen and ozone at a pressure of from about 1 up to about 50 atmospheres and also exposing the resulting product to ultra-violet light rays; and (iv) passing the resulting product through an operating clothes drier thereby producing a mixture of $C_6$–$C_{15}$ straight chain aldehydes in said natural fiber which yields an enhanced fresh air dried aroma, said mixture of aldehydes consisting essentially of:

(a) from about 0.5 up to about 5% by weight of said aldehyde composition of n-hexanal;

(b) from about 2 up to about 12% by weight of said aldehyde composition of n-heptanal;

(c) from about 5 up to about 15% by weight of said aldehyde composition of n-octanal;

(d) from about 40 up to about 70% by weight of said aldehyde composition of n-nonanal;

(e) from about 10 up to about 30% by weight of said aldehyde composition of n-decanal;

(f) from about 0.5 up to about 5% by weight of said aldehyde composition of n-undecanal;

(g) from about 0.5 up to about 5% by weight of said aldehyde composition of n-dodecanal;

(h) from about 0.5 up to about 5% by weight of said aldehyde composition of n-tridecanal;

(i) from about 0 up to about 5% by weight of said aldehyde composition of n-tetradecanal;

(j) from about 0 up to about 5% by weight of said aldehyde composition of n-pentadecanal.

However, nothing in the prior art discloses the use of the combination:

(a) from about 0.5 up to about 7% by weight of said composition of n-hexanal;

(b) from about 5 up to about 21% by weight of said composition of n-octanal;

(c) from about 30 up to about 80% by weight of said composition of n-nonanal;

(d) from 0 up to about 40% by weight of said composition of n-decanal;

(e) from 0 up to about 7% by weight of said composition of n-tetradecanal;

(f) from about 7 up to about 12% by weight of said composition of n-heptanal;

(g) from 0 up to about 12% by weight of said composition of n-undecanal; and (h) from 0 up to about 12% by weight of said composition of n-dodecanal, in augmenting or enhancing the aroma or taste of smoking tobacco compositions or smoking tobacco articles including the environment surrounding the smoking tobacco article as it is smoked.

THE INVENTION

We have discovered a technique for fulfilling the need for modifying the smokey, phenolic, cresolic aroma surrounding a smoking tobacco article as it is smoked.

We have, more specifically, discovered that the composition of matter, to wit:

(a) from about 0.5 up to about 7% by weight of said composition of n-hexanal;
(b) from about 5 up to about 21% by weight of said composition of n-octanal;
(c) from about 30 up to about 80% by weight of said composition of n-nonanal;
(d) from 0 up to about 40% by weight of said composition of n-decanal;
(e) from 0 up to about 7% by weight of said composition of n-tetradecanal;
(f) from about 7 up to about 12% by weight of said composition of n-heptanal;
(g) from 0 up to about 12% by weight of said composition of n-undecanal; and
(h) from 0 up to about 12% by weight of said composition of n-dodecanal, gives rise to a fresh, clean, slightly citrusy aroma in the main stream and the side stream of the cigarette on smoking and further masks the smokey, phenolic, cresolic odor in the main stream and the side stream and in the environment surrounding the smoking tobacco article as it is smoked.

Hence, our invention provides an organoleptically improved smoking tobacco product and additives therefor as well as methods for making the same which overcome problems heretofore encountered in which fresh, clean, citrusy flavor characteristics and aroma characteristics are used to augment or enhance the aroma or taste of smoking tobacco compositions and smoking tobacco articles and, in addition, modify and mask the smokey, phenolic, cresolic aroma of the smoking tobacco article as it is smoked or when it is in use.

This invention further provides improved tobacco additives and methods whereby various desirable flavoring characteristics and aromatization characteristics may be imparted to smoking tobacco products and may be readily varied and controlled to produce the desired uniform flavoring characteristics.

In carrying out this aspect of our invention we add to smoking tobacco materials or a suitable substitute therefor, (e.g., dried lettuce leaves) or to a component of a smoking tobacco article, e.g., the wrapper of a cigarette or the filter of a cigarette, an aroma and flavor additive containing as an active ingredient a composition of matter defined according to the following formula:

(a) from about 0.5 up to about 7% by weight of said composition of n-hexanal;
(b) from about 5 up to about 21% by weight of said composition of n-octanal;
(c) from about 30 up to about 80% by weight of said composition of n-nonanal;
(d) from 0 up to about 40% by weight of said composition of n-decanal;
(e) from 0 up to about 7% by weight of said composition of n-tetradecanal;
(f) from about 7 up to about 12% by weight of said composition of n-heptanal;
(g) from 0 up to about 12% by weight of said composition of n-undecanal; and
(h) from 0 up to about 12% by weight of said composition of n-dodecanal.

In addition to the composition of matter defined, thusly:

(a) from about 0.5 up to about 7% by weight of said composition of n-hexanal;
(b) from about 5 up to about 21% by weight of said composition of n-octanal;
(c) from about 30 up to about 80% by weight of said composition of n-nonanal;
(d) from 0 up to about 40% by weight of said composition of n-decanal;
(e) from 0 up to about 7% by weight of said composition of n-tetradecanal;
(f) from about 7 up to about 12% by weight of said composition of n-heptanal;
(g) from 0 up to about 12% by weight of said composition of n-undecanal; and
(h) from 0 up to about 12% by weight of said composition of n-dodecanal, other flavoring and aroma additives may be added to the smoking tobacco material or substitute therefor, or to a component of the smoking tobacco article either separately or in admixture with the mixture of aldehydes as follows:

I. SYNTHETIC MATERIALS

Beta-ethyl-cinnamaldehyde;
Eugenol;
Dipentene;
Beta-Damascenone;
Maltol;
Ethyl maltol;
Delta undecalactone;
Delta decalactone;
Benzaldehyde;
Amyl acetate;
Ethyl butyrate;
Ethyl valerate;
Ethyl acetate;
2-Hexenol-1;
2-Methyl-5-isopropyl-1,3-nonadiene-8-one;
2,6-Dimethyl-2,6-undecadiene-10-one;
2-Methyl-5-isopropylacetophenone;
2-Hydroxy-2,5,5,8a-tetramethyl-1-(2-hydroxyethyl)-decahydronaphthalene;
Dodecahydro-3a,6,6-9a-tetramethylnaphtho-(2,1-b-)-furan;
4-Hydroxyhexanoic acid, gamma lactone; and
Polyisoprenoid hydrocarbons defined in Example V of U.S. Pat. No. 3,589,372 issued on 6/29/71.

II. NATURAL OILS

Celery seed oil;
Coffee extract;
Bergamot oil;
Cocoa extract;
Nutmeg oil; and
Origanum oil.

An aroma and flavoring concentrate containing a mixture defined, thusly:

(a) from about 0.5 up to about 7% by weight of said composition of n-hexanal;
(b) from about 5 up to about 21% by weight of said composition of n-octanal;

(c) from about 30 up to about 80% by weight of said composition of n-nonanal;
(d) from 0 up to about 40% by weight of said composition of n-decanal;
(e) from 0 up to about 7% by weight of said composition of n-tetradecanal;
(f) from about 7 up to about 12% by weight of said composition of n-heptanal;
(g) from 0 up to about 12% by weight of said composition of n-undecanal; and
(h) from 0 up to about 12% by weight of said composition of n-dodecanal, and if desired, one or more of the above-indicated additional flavoring additives may be added to the smoking tobacco material, to the filter or to the leaf or paper wrapper. The smoking tobacco material may be shredded, cured, cased and blended together material or reconstituted tobacco material or tobacco substitutes (e.g., lettuce leaves) or mixtures thereof. The proportions of flavoring additives may be varied in accordance with the taste but insofar as enhancement or the imparting of fresh, clean, citrusy notes are concerned and insofar as the masking of the smokey, phenolic, cresolic odor around the smoking tobacco article and in the main stream and the side stream is concerned we have found that satisfactory results are obtained if the proportion by weight of the sum total of aldehydes of the composition of matter, to wit:

(a) from about 0.5 up to about 7% by weight of said composition of n-hexanal;
(b) from about 5 up to about 21% by weight of said composition of n-octanal;
(c) from about 30 up to about 80% by weight of said composition of n-nonanal;
(d) from 0 up to about 40% by weight of said composition of n-decanal;
(e) from 0 up to about 7% by weight of said composition of n-tetradecanal;
(f) from about 7 up to about 12% by weight of said composition of n-heptanal;
(g) from 0 up to about 12% by weight of said composition of n-undecanal; and
(h) from 0 up to about 12% by weight of said composition of n-dodecanal, to smoking tobacco material is between 50 ppm and 1,500 ppm (0.015%–0.15%). We have further found that satisfactory results are obtained if the proportions by weight of the sum total of aldehydes of the composition of our invention, to wit:

(a) from about 0.5 up to about 7% by weight of said composition of n-hexanal;
(b) from about 5 up to about 21% by weight of said composition of n-octanal;
(c) from about 30 up to about 80% by weight of said composition of n-nonanal;
(d) from 0 up to about 40% by weight of said composition of n-decanal;
(e) from 0 up to about 7% by weight of said composition of n-tetradecanal;
(f) from about 7 up to about 12% by weight of said composition of n-heptanal;
(g) from 0 up to about 12% by weight of said composition of n-undecanal; and
(h) from 0 up to about 12% by weight of said composition of n-dodecanal, used to flavoring material is between 1,500 and 15,000 ppm (0.15%–1.5%).

Any convenient method for incorporating the aldehyde composition into the tobacco product may be employed. Thus the aldehyde composition set forth, supra, taken alone or along with other flavoring additives may be dissolved in a suitable solvent such as ethanol, diethylether and/or propylene glycol and the resulting solution may either be spread on the cured, cased and blended tobacco material or the tobacco material may be dipped into such a solution. Under certain circumstances, a solution of the aldehyde derivatives of the composition of matter, to wit:

(a) from about 0.5 up to about 7% by weight of said composition of n-hexanal;
(b) from about 5 up to about 21% by weight of said composition of n-octanal;
(c) from about 30 up to about 80% by weight of said composition of n-nonanal;
(d) from 0 up to about 40% by weight of said composition of n-decanal;
(e) from 0 up to about 7% by weight of said composition of n-tetradecanal;
(f) from about 7 up to about 12% by weight of said composition of n-heptanal;
(g) from 0 up to about 12% by weight of said composition of n-undecanal; and
(h) from 0 up to about 12% by weight of said composition of n-dodecanal, of our invention taken alone or taken further together with other flavoring additives as set forth above may be applied by means of a suitable applicator such as a brush or roller on the paper or leaf wrapper for the smoking tobacco product or it may be applied to the filter by either spraying or dipping or coating.

Furthermore, it will be apparent that only a portion of the tobacco or substitute therefor need be treated and the thus-treated tobacco may be blended with other tobaccos before the ultimate tobacco product is formed. In such cases, the tobacco treated will initially have the aldehyde derivative composition of matter of our invention in excess of the amounts or concentrations above-indicated so that when blended with other tobaccos the final product will have the percentage within the indicated range.

In accordance with one specific example of our invention, an aged, cured and shredded domestic tobacco is sprayed with a 20% ethanol solution of the following composition of matter:

2.2% n-hexanal
20.0% n-octanal
75.0% n-nonanal
2.8% n-tetradecanal to provide a tobacco composition containing 800 ppm by weight of the mixture of aldehydes on a dry basis. Thereafter, the alcohol is removed by evaporation and the tobacco is manufactured into cigarettes by the usual techniques. The cigarette when treated as indicated has a desired and pleasing clean, fresh aroma which is detectable in the main stream and the side stream when the cigarette is smoked. This aroma also gives rise to the masking of the smokey, phenolic, cresolic odor present in most cigarettes on smoking and also present in the environment surrounding the smoker during the smoking operation.

While our invention is particularly useful in the manufacture of smoking tobacco such as cigarette tobacco, cigar tobacco and pipe tobacco, other tobacco products, formed from sheeted tobacco dust or fines may also be used. Likewise the mixture of aldehydes of our invention can be incorporated with materials such as filter tip materials (e.g., cellulose acetate filters) wherein the citrusy and clean, fresh effects are obtained and the smokey, phenolic, cresolic odor is covered or modified, seam paste, packaging materials and the like which are used along with tobacco to form a product adapted for smoking. Furthermore, the aldehyde mixtures can be added to certain tobacco substitutes of natural or synthetic origin (e.g., dry lettuce leaves) and, accordingly, by the term "tobacco" as used throughout this specification is meant any composition intended for human consumption by smoking or otherwise whether composed of tobacco plant products or substitute materials, or both.

EXAMPLE I

TOBACCO FORMULATION

A tobacco mixture is produced by admixing the following ingredients:

| Ingredient | Parts by Weight |
|---|---|
| Bright | 40.1 |
| Burley | 24.9 |
| Maryland | 1.1 |
| Turkish | 11.6 |
| Stem (flue-cured) | 14.2 |
| Glycerine | 2.8 |
| Water | 5.3 |

Cigarettes are prepared from this tobacco. The following flavor formulation is prepared:

| Ingredient | Parts by Weight |
|---|---|
| Ethyl butyrate | .05 |
| Ethyl valerate | .05 |
| Maltol | 2.00 |
| Cocoa extract | 26.00 |
| Coffee extract | 10.00 |
| Ethyl alcohol | 20.00 |
| Water | 41.90 |

The above-stated tobacco flavor is applied at the rate of 0.1% to all of the cigarettes produced using the above tobacco formulation. Half of the cigarettes are then treated with 500 and 1,500 ppm of a mixture of aldehydes consisting of:

2.2% weight percent n-hexanal
20.0% weight percent n-octanal
75.0% weight percent n-nonanal
2.8% weight percent n-tetradecanal Control cigarettes not containing such aldehyde compositions and the experimental cigarettes which contain the aldehyde composition are evaluated by paired comparison and the results are as follows:

"The experimental cigarettes are found, on smoking, to have a clean, fresh, citrusy taste with much more body and much more natural tobacco-like aroma prior to smoking and on smoking in the main stream and the side stream. In addition, surprisingly, a smokey, phenolic, cresolic aroma usually surrounding such a cigarette on consumption thereof has been effectively masked."

All cigarettes are evaluated for smoke flavor with a 20 mm cellulose acetate filter.

What is claimed is:

1. A process for augmenting or enhancing the aroma or taste of a smoking tobacco comprising the step of intimately admixing with the smoking tobacco, an aroma or taste augmenting or enhancing quantity of a composition of matter consisting essentially of:
   (a) from about 0.5 up to about 7% by weight of said composition of n-hexanal;
   (b) from about 5 up to about 21% by weight of said composition of n-octanal;
   (c) from about 30 up to about 80% by weight of said composition of n-nonanal;
   (d) from 0 up to about 40% by weight of said composition of n-decanal;
   (e) from 0 up to about 7% by weight of said composition of n-tetradecanal;
   (f) from about 7 up to about 12% by weight of said composition of n-heptanal;
   (g) from 0 up to about 12% by weight of said composition of n-undecanal; and
   (h) from 0 up to about 12% by weight of said composition n-dodecanal.

2. A process for augmenting or enhancing the aroma or taste of a smoking tobacco article comprising a filter, a cylindrical body of tobacco and a wrapper surrounding said cylindrical body of tobacco and said filter comprising the step of adding to said wrapper or said cylindrical body of tobacco, an aroma or taste augmenting or enhancing quantity of a composition of matter consisting essentially of:
   (a) from about 0.5 up to about 7% by weight of said composition of n-hexanal;
   (b) from about 5 up to about 21% by weight of said composition of n-octanal;
   (c) from about 30 up to about 80% by weight of said composition of n-nonanal;
   (d) from 0 up to about 40% by weight of said composition of n-decanal;
   (e) from 0 up to about 7% by weight of said composition of n-tetradecanal;
   (f) from about 7 up to about 12% by weight of said composition of n-heptanal;
   (g) from 0 up to about 12% by weight of said composition of n-undecanal; and
   (h) from 0 up to about 12% by weight of said composition n-dodecanal.

3. A smoking tobacco composition comprising smoking tobacco and intimately admixed therewith, an aroma or taste augmenting or enhancing quantity of a composition of matter consisting essentially of:
   (a) from about 0.5 up to about 7% by weight of said composition of n-hexanal;
   (b) from about 5 up to about 21% by weight of said composition of n-octanal;
   (c) from about 30 up to about 80% by weight of said composition of n-nonanal;
   (d) from 0 up to about 40% by weight of said composition of n-decanal;
   (e) from 0 up to about 7% by weight of said composition of n-tetradecanal;
   (f) from about 7 up to about 12% by weight of said composition of n-heptanal;
   (g) from 0 up to about 12% by weight of said composition of n-undecanal; and
   (h) from 0 up to about 12% by weight of said composition n-dodecanal.

4. A smoking tobacco article comprising a cylindrical body of smoking tobacco immediately adjacent to a filter and a wrapper surrounding said filter and said cylindrical body of smoking tobacco and in intimate contact with said wrapper, said or said cylindrical body of smoking tobacco, an aroma augmenting or enhancing quantity of a composition of matter consisting essentially of:

(a) from about 0.5 up to about 7% by weight of said composition of n-hexanal;
(b) from about 5 up to about 21% by weight of said composition of n-octanal;
(c) from about 30 up to about 80% by weight of said composition of n-nonanal;
(d) from 0 up to about 40% by weight of said composition of n-decanal;
(e) from 0 up to about 7% by weight of said composition of n-tetradecanal;
(f) from about 7 up to about 12% by weight of said composition of n-heptanal;
(g) from 0 up to about 12% by weight of said composition of n-undecanal; and
(h) from 0 up to about 12% by weight of said composition n-dodecanal.

* * * * *